US010661416B2

(12) United States Patent
Su

(10) Patent No.: US 10,661,416 B2
(45) Date of Patent: May 26, 2020

(54) DRIVING TOOL WITH PIVOTAL DRIVING END

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 0 days.

(21) Appl. No.: 15/852,015

(22) Filed: Dec. 22, 2017

(65) Prior Publication Data

US 2018/0185994 A1 Jul. 5, 2018

(30) Foreign Application Priority Data

Jan. 5, 2017 (TW) ..... 106100325 A

(51) Int. Cl.
*B25B 23/00* (2006.01)
*B25B 21/00* (2006.01)

(52) U.S. Cl.
CPC ..... *B25B 23/0028* (2013.01); *B25B 23/0035* (2013.01); *B25B 21/00* (2013.01)

(58) Field of Classification Search
CPC .. B25B 23/0028; B25B 23/0035; B25B 21/00
See application file for complete search history.

(56) References Cited

U.S. PATENT DOCUMENTS

| | | | | |
|---|---|---|---|---|
| 9,205,543 | B1 * | 12/2015 | Chen | B25B 23/0035 |
| 9,776,310 | B2 * | 10/2017 | Chen | B25B 23/0028 |
| 2011/0281659 | A1 * | 11/2011 | Yamashita | B25B 13/481 464/159 |
| 2015/0165605 | A1 * | 6/2015 | Chern | B25B 23/0035 403/66 |
| 2016/0265596 | A1 * | 9/2016 | Yu | B25B 23/0035 |
| 2017/0254365 | A1 * | 9/2017 | Chen | F16D 3/221 |

FOREIGN PATENT DOCUMENTS

| | | | |
|---|---|---|---|
| CN | 205521123 | U | 8/2016 |
| TW | 325107 | U | 1/1998 |
| TW | M357344 | U | 5/2009 |
| TW | M513092 | U | 12/2015 |

* cited by examiner

*Primary Examiner* — David B. Thomas
(74) *Attorney, Agent, or Firm* — Alan D. Kamrath; Karin L. Williams; Mayer & Williams PC

(57) ABSTRACT

A driving tool with a pivotal driving end includes a first driving body and a second driving body. The first driving body has a receptacle with a polygonal side. The polygonal side includes a plurality of concave sides and a plurality of convex sides. Each of the plurality of concave sides in a cross-section perpendicular to the first axis is curved circularly. Each of the plurality of convex sides in a cross-section perpendicular to the first axis is curved elliptically. The second driving body is pivotally coupled to first driving body. The second driving body has a ball head. The ball head is retained in the receptacle. The ball head includes a plurality of protruding lobes corresponding to the plurality of concave sides and a plurality of recesses corresponding to the plurality of convex sides.

20 Claims, 9 Drawing Sheets

DRIVING TOOL WITH PIVOTAL DRIVING END

BACKGROUND OF THE INVENTION

1. Field of the Invention

The present invention relates to a driving tool and, particularly, to a driving tool with a pivotal driving end.

2. Description of the Related Art

TW Pat. No. M357344 shows an articulated tool joint including a shank portion, a drive head portion with a ball end articulated with the shank portion, and a retainer for preventing the drive head portion falling out of the shank portion. The shank portion has a bore with a plurality of sides. The ball end of the drive head portion is received within the bore and has a plurality of lobes co-acting with the plurality of sides. The drive head portion is movable to an aligned position and a tilted position with respect to the shank portion.

It is common to use a power tool to drive the articulated tool joint. However, the power tool can generate a large instant force that could deform the shank portion and the drive head portion substantially and jam the drive head portion in the shank portion.

The present invention is, therefore, intended to obviate or at least alleviate the problems encountered in the prior art.

SUMMARY OF THE INVENTION

According to the present invention, a driving tool with a pivotal driving end includes a first driving body and a second driving body. The first driving body has a receptacle with a polygonal side. The polygonal side includes a plurality of concave sides and a plurality of convex sides. The plurality of concave sides and the plurality of convex sides are alternately arranged. Each of the plurality of concave sides and the plurality of convex sides extends along a first axis. Each of the plurality of concave sides in a cross-section perpendicular to the first axis is curved circularly. Each of the plurality of convex sides in a cross-section perpendicular to the first axis is curved elliptically. Each of the plurality of convex sides is tangentially connected to two concave sides adjacent thereto such that a phantom ellipse conforming to the shape of the convex sides is tangentially connected to two phantom circles conforming to the shapes of the concave sides. The second driving body is pivotally coupled to first driving body. The second driving body has a ball head. The ball head is retained in the receptacle. The ball head includes a plurality of protruding lobes corresponding to the plurality of concave sides and a plurality of recesses corresponding to the plurality of convex sides. Each of the protruding lobes and the plurality of recesses extends along a second axis.

The second driving body is pivotal from a first position aligned with the first driving body such that the first and second axes are aligned to a second position oriented at a maximum angle to the first driving body such that the first and second axes are tilted with respect to one another.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
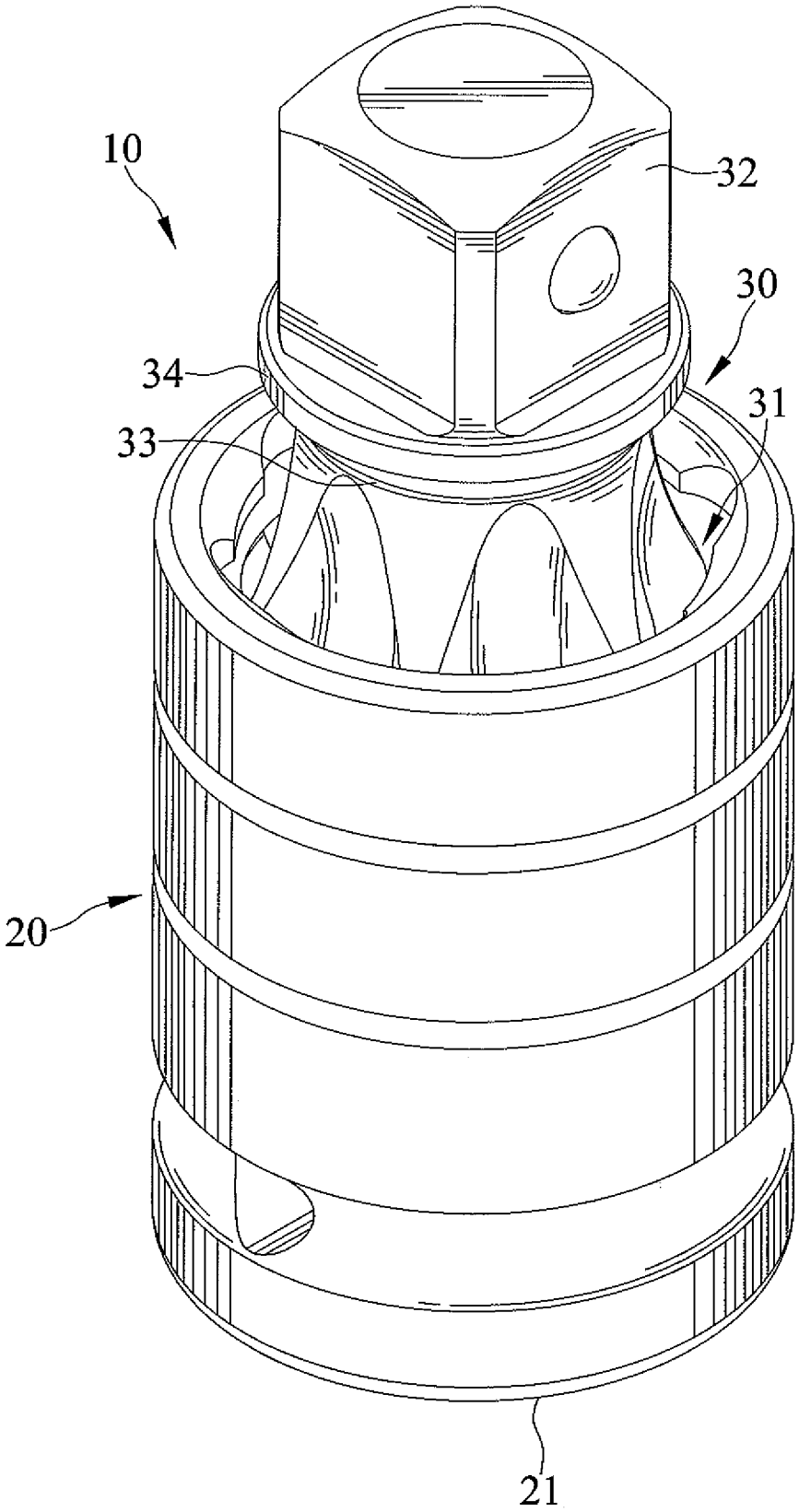
FIG. 1 is a perspective view of a driving tool with a pivotal driving end in accordance with a first embodiment of the present invention.
Figure 2:
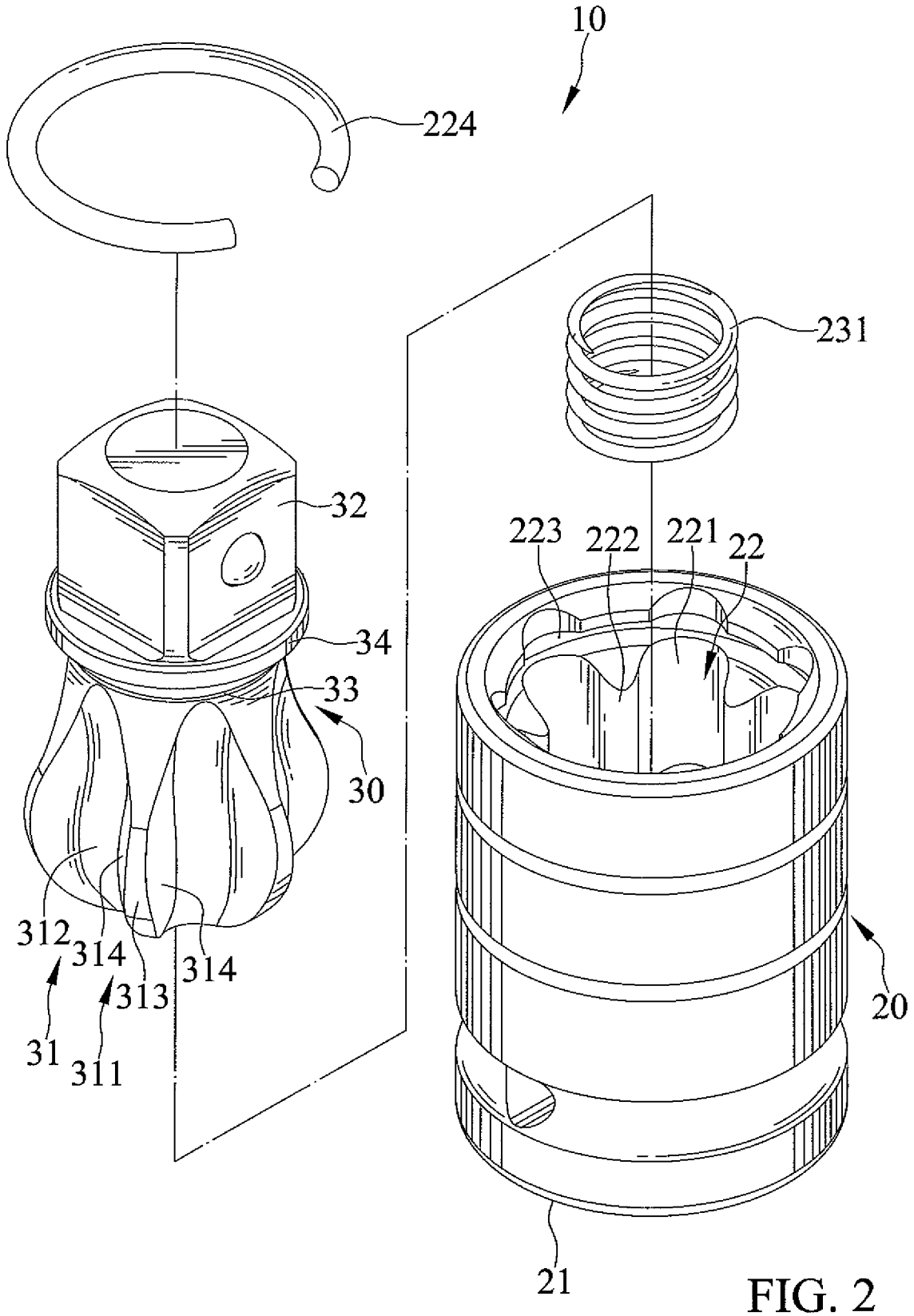
FIG. 2 is an exploded perspective view of the driving tool shown in FIG. 1.
Figure 3:
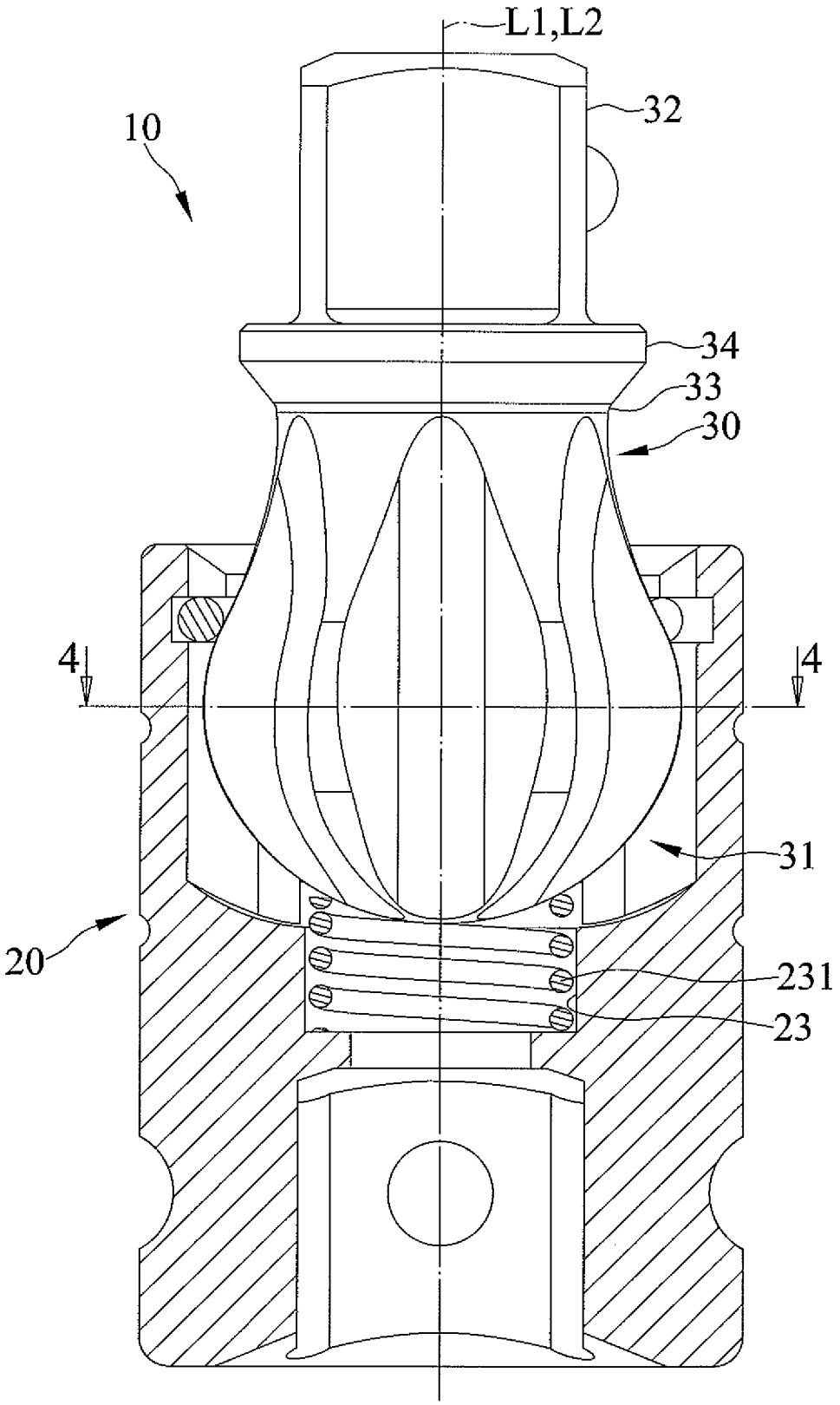
FIG. 3 is a cross-sectional view of the driving tool shown in FIG. 1, with the driving tool in an aligned position.

FIGS. 1 through 7 show a driving tool 10 with a pivotal driving end in accordance with a first embodiment of the present invention. The driving tool 10 includes a first driving body 20 and a second driving body 30.

The first driving body 20 has a connecting end 21 and a receptacle 22. The connecting end 21 and the receptacle 22 are on opposite ends of the first driving body 20. The first driving body 20 extends along a first axis L1 from the connecting end 21 to the receptacle 22. The connecting end 21 is adapted to connect to a power tool. The connecting end 21 forms a hole with which the power tool engages. The receptacle 22 has a polygonal side. The polygonal side includes a plurality of concave sides 221 and a plurality of convex sides 222. The plurality of concave sides 221 and the plurality of convex sides 222 are alternately arranged. The number of the plurality of concave sides (221) is six. Each of the plurality of concave sides 221 and the plurality of convex sides 222 extends along a first axis L1. Each of the plurality of concave sides 221 in a cross-section perpendicular to the first axis L1 is curved circularly. Each of the plurality of convex sides 222 in a cross-section perpendicular to the first axis L1 is curved elliptically. Each of the plurality of convex sides 222 is tangentially connected to two concave sides 221 adjacent thereto such that a phantom ellipse E conforming to the shape of the convex sides 222 is tangentially connected to two phantom circles C conforming to the shapes of the concave sides 221. The two phantom circles C are located in the receptacle 22. The phantom ellipse E is located outside the receptacle 22. Further, a major axis of the phantom ellipse E, which passes through a center of the phantom ellipse E, is coaxial with a line L3 extending from a center O of the receptacle to the center of the phantom ellipse E.

The second driving body 30 is pivotally coupled to first driving body 20. The second driving body 30 has a ball head 31, a drive head 32, and a neck 33. The drive head 32 is opposite the ball head 31. The second driving body 30 extends along a second axis L2 from the ball head 31 to the drive head 32. The drive head 32 has a detent retained thereon. The drive head 32 is polygonal in shape and has a ball detent. The ball detent is retained on the drive head 32. Furthermore the ball detent protrudes out of the drive head 32. The second driving body 30 is urged by a biasing member 231. The biasing member 231 is retained in a bore 23. The biasing member 231 has an end abutting and urging the ball head 31. The second distal end of the ball head 31 is abutted by the biasing member 231. The biasing member 231 is a compression spring. The ball head 31 has a first distal end contiguous to the neck 33, a medium, and a second distal end distal to the neck 33. The ball head 31 increases in width from the first end to the medium and decreases in width from the medium to the second distal end. The ball head 31 is retained in the receptacle 22. The ball head 31 includes a plurality of protruding lobes 311 corresponding to the plurality of concave sides 221 and a plurality of recesses 312 corresponding to the plurality of convex sides 222. The number of plurality of protruding lobes 311 is six. Each of the protruding lobes 311 and the plurality of recesses 312 extends along the second axis L2. Each of the plurality of protruding lobes 311 has a curved top surface 313 and two curved lateral surfaces 314. The top surface 313 is positioned between the two curved lateral surfaces 314. Each of the plurality of recesses 312 extends between to two protruding lobes 311 adjacent thereto. The two curved lateral surfaces 314 of each of the plurality of protruding lobes 311 are convex surfaces.

The second driving body 30 has a shoulder 34. The shoulder 34 extends radially with respect to the second axis L2. The shoulder 34 has a width greater than a width of the neck 33. The width of the shoulder 34 is also greater than a width of the drive head 32.

Figure 4:
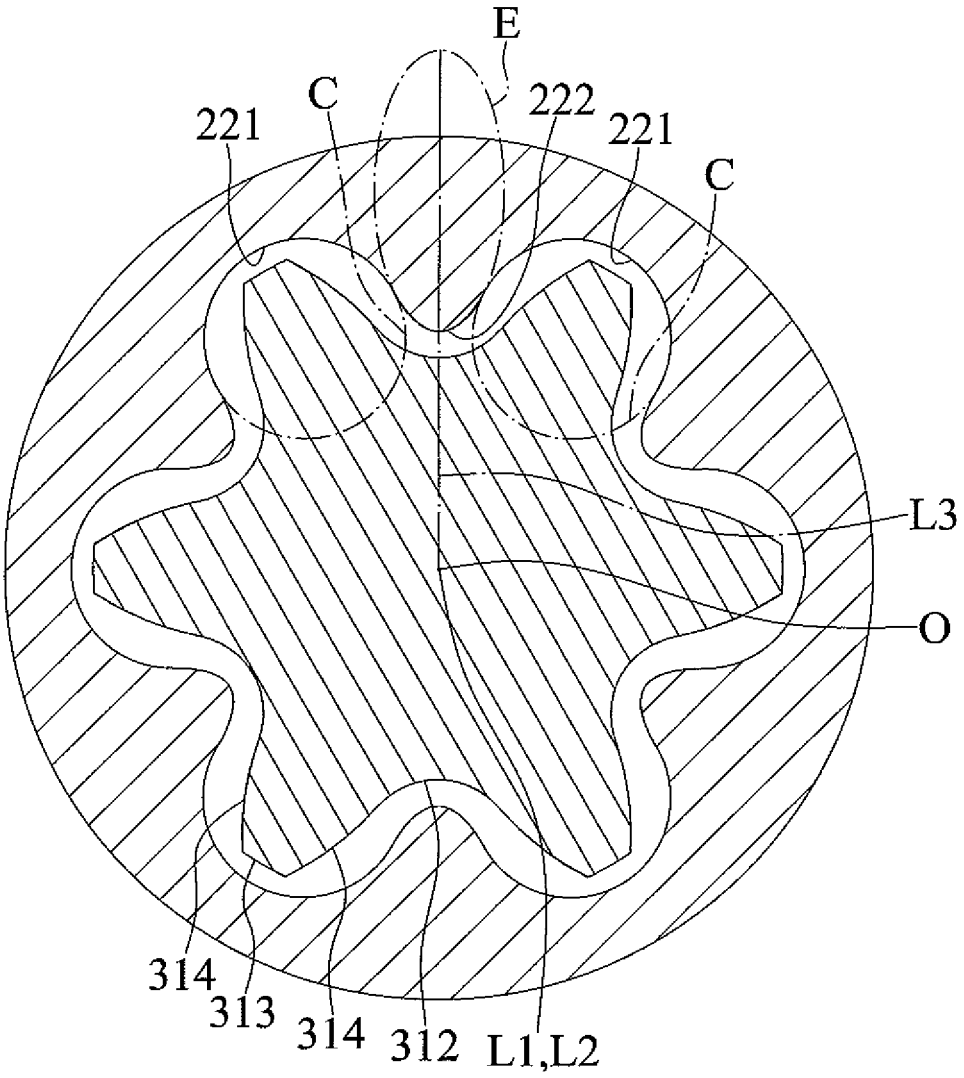
FIG. 4 is a cross-sectional view taken along line 4-4 of FIG. 3.
Figure 5:
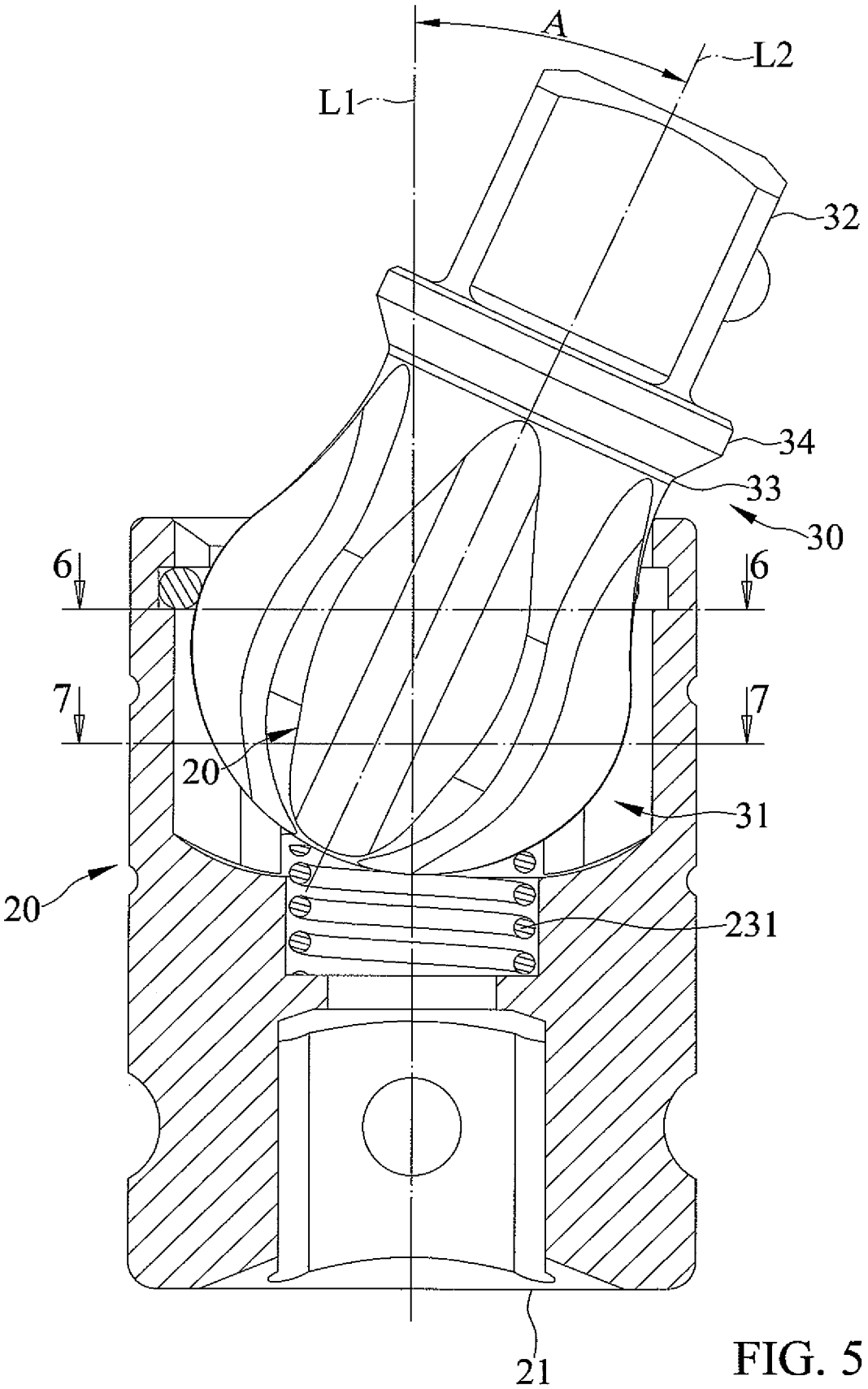
FIG. 5 is a cross-sectional view of the driving tool shown in FIG. 1, with the driving tool pivoted to a tilt position.
Figure 6:
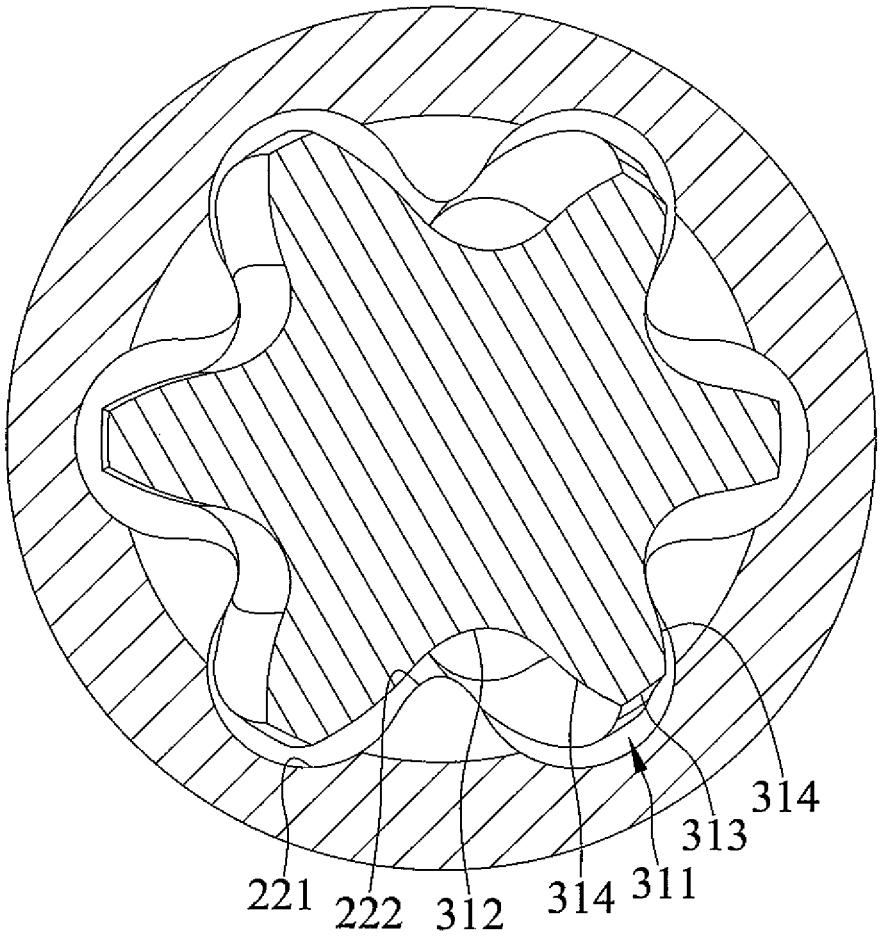
FIG. 6 is cross-sectional view taken along line 6-6 of FIG. 5.
Figure 7:
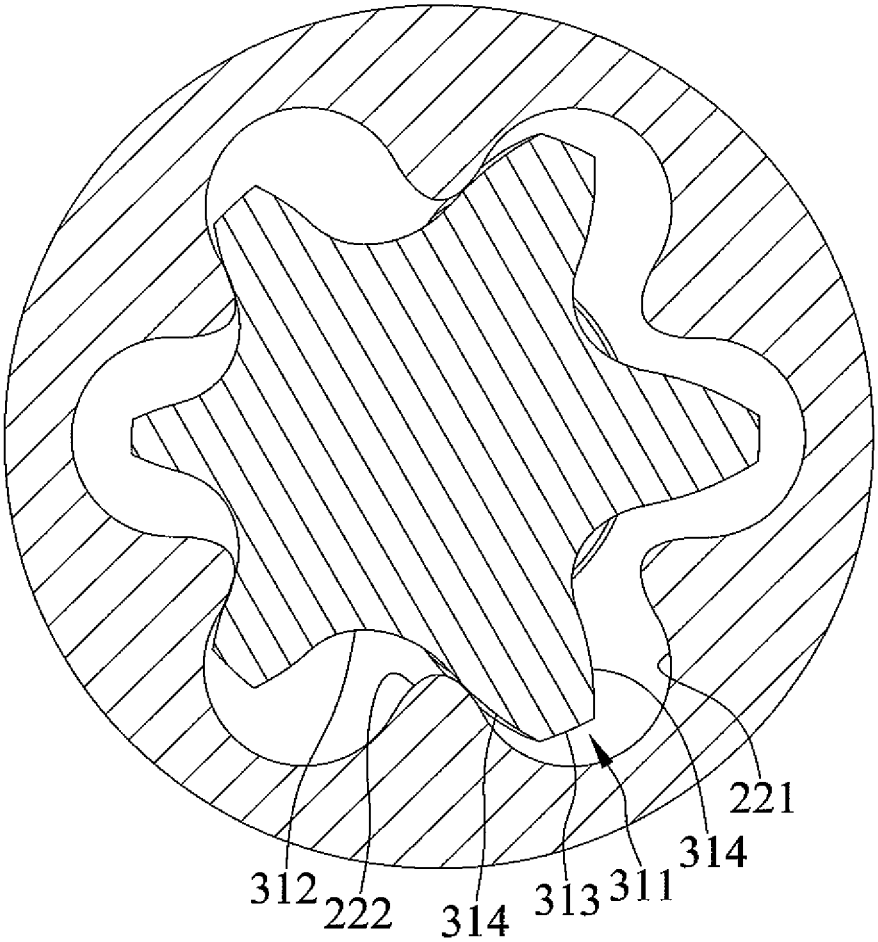
FIG. 7 is a cross-sectional view taken along line 7-7 of FIG. 5.

The second driving body 30 is pivotal to a first position aligned with the first driving body 20 such that the first and second axes L1 and L2 are aligned. FIG. 4 shows the ball head 31 is not in contact with the receptacle 22. The second driving body 30 is pivotal to a second position oriented at a maximum angle A to the first driving body 20 such that the first and second axes L1 and L2 are tilted with respect to one another. The maximum angle A is an acute angle. The maximum angle A is 25 degrees. The receptacle and the ball head 22 and 31 have six points of contact therebetween when the second driving body 30 is pivoted to the second position with respect to the first driving body 20. FIG. 6 shows the receptacle and the ball head 22 and 31 have two points of contact therebetween. Moreover, FIG. 7 shows the receptacle and the ball head 22 and 31 have four points of contact therebetween. When the second driving body 30 is in the first position aligned with the first driving body 20, the shoulder 34 is located outside of the receptacle 22. When the second driving body 30 is in the second position oriented at the maximum angle A to the first driving body 20, the shoulder 34 is located outside of the receptacle 22.

A retainer 224 is engaged between the first and second driving bodies 20 and 30 for retaining the ball head 31 in the receptacle 22. The first driving body 20 has a slot 223. The retainer 224 is retained in the slot 223. The retainer 224 extends annularly and abuts a circumference of the ball head 31 at a height. The slot 223 extends annularly and is adjacent to an open end of the receptacle 22. The retainer 224 is a resilient clip. The clip is C shaped.

Figure 8:
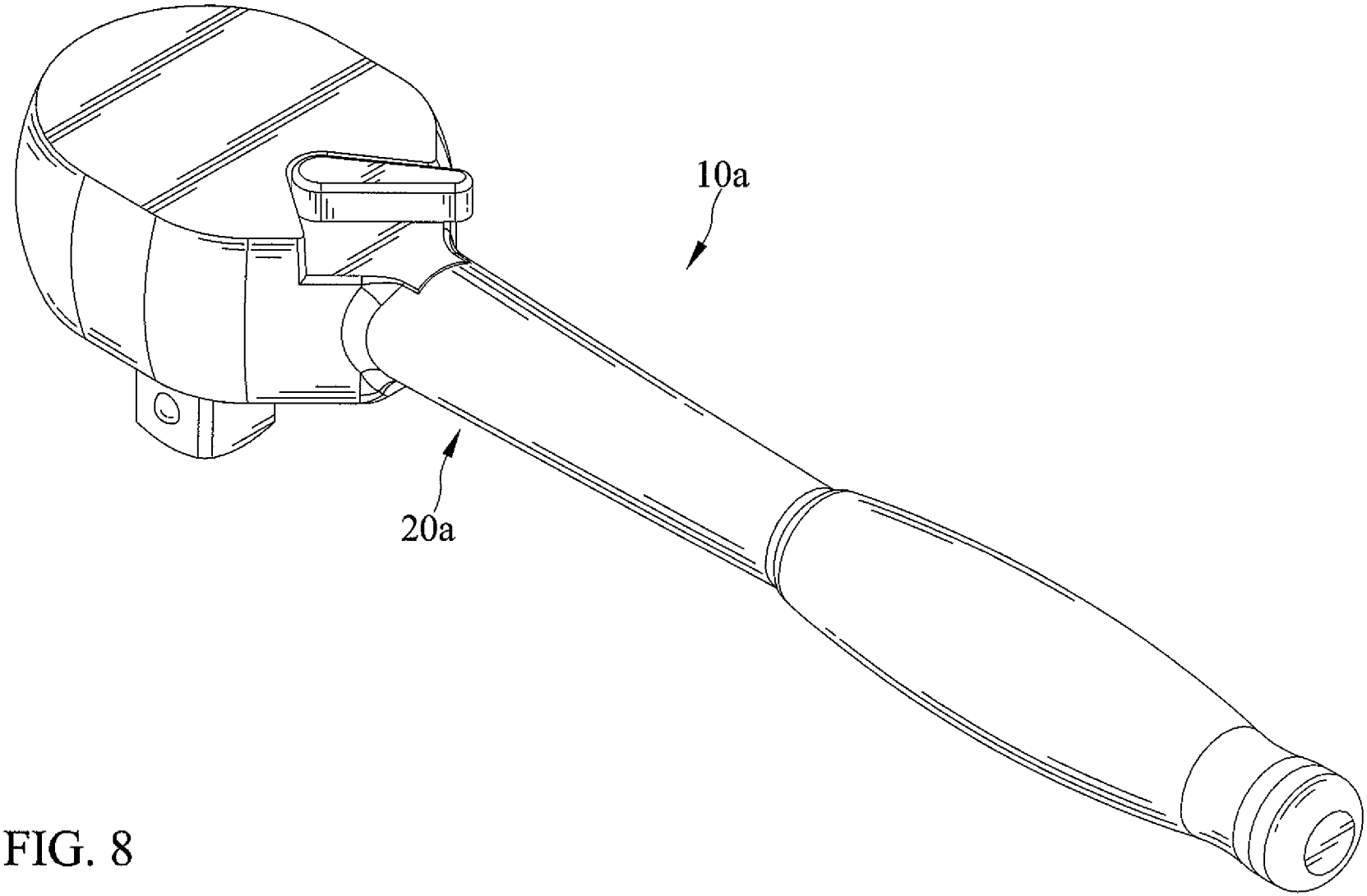
FIG. 8 is a perspective view of a driving tool with a pivotal driving end in accordance with a second embodiment of the present invention.
Figure 9:
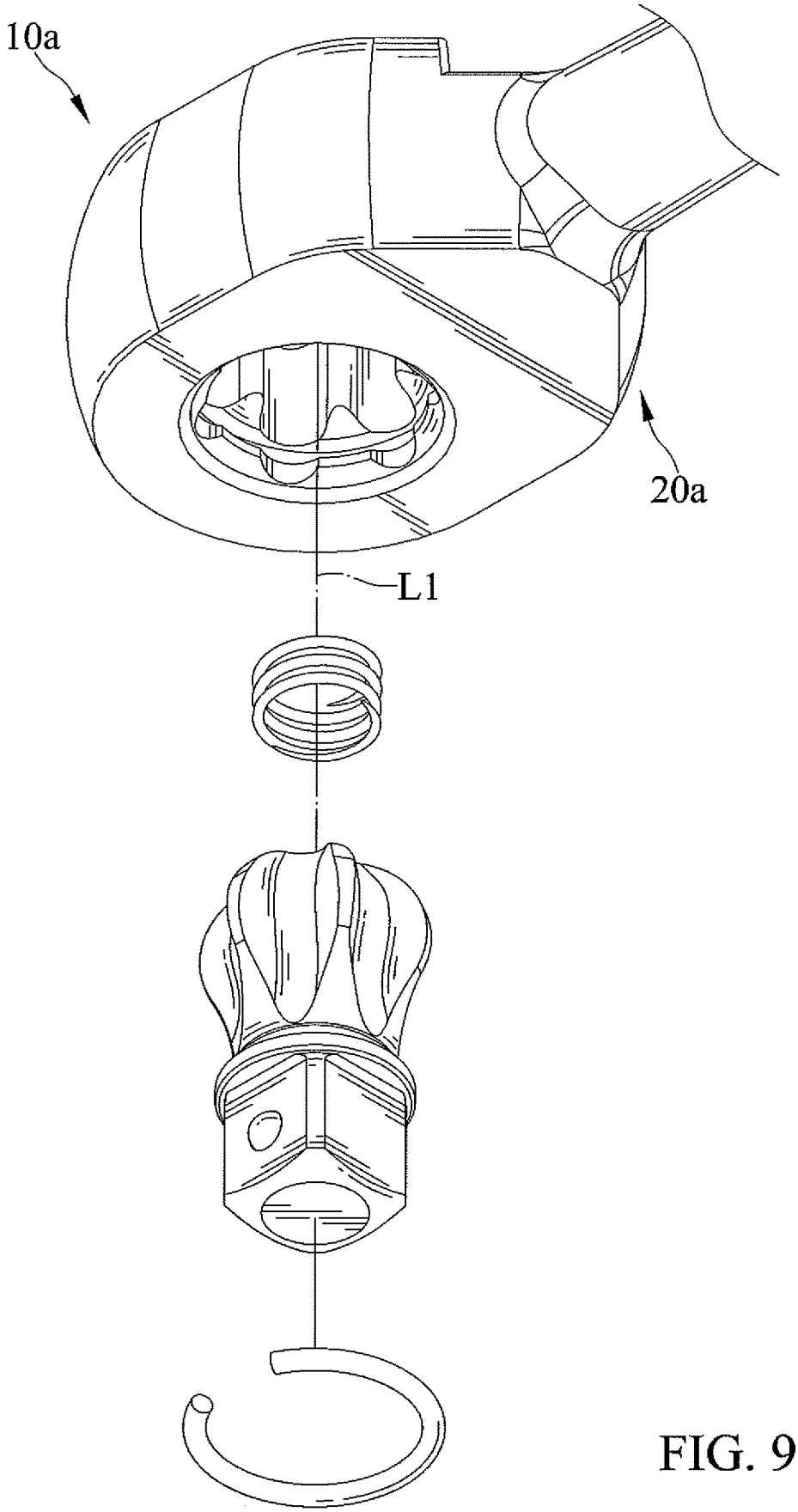
FIG. 9 is an exploded perspective view of the driving tool shown in FIG. 8.

FIGS. 8 and 9 show a driving tool 10*a* with a pivotal driving end in accordance with a second embodiment of the present invention, and the same numbers are used to correlate similar components of the first embodiment, but bearing a letter a. The second embodiment differentiates from first embodiment in that a first driving body 20*a* has a shaft adapted to be used as a lever extending transversely to the first axis L1.

In view of the foregoing, when the second driving body 30 is pivotal to a second position oriented at the maximum angle A to the first driving body 20 or 20*a*, the ball head 31 and the receptacle 22 are contacted with one another in a satisfied manner to withstand a large torque transmission.

The foregoing is merely illustrative of the principles of this invention, and various modifications can be made by those skilled in the art without departing from the scope and spirit of the invention.

What is claimed is:

1. A driving tool with a pivotal driving end comprising:

a first driving body having a receptacle with a polygonal side, with the polygonal side including a plurality of concave sides and a plurality of convex sides, with the plurality of concave sides and the plurality of convex sides alternately arranged, with each of the plurality of concave sides and the plurality of convex sides extending along a first axis, with each of the plurality of concave sides, in cross section, being perpendicular to the first axis and curved circularly, with each of the plurality of convex sides, in cross section, being perpendicular to the first axis and curved elliptically, with each of the plurality of convex sides tangentially connected to two of the plurality of concave sides adjacent thereto, with the shape of each of the plurality of convex sides conforming to a phantom ellipse, with the shapes of the two of the plurality of concave sides adjacent thereto each conforming to a phantom circle, and with the phantom ellipse tangentially connected to the adjacent two phantom circles; and a second driving body pivotally coupled to first driving body, wherein the second driving body has a ball head, with the ball head retained in the receptacle, with the ball head including a plurality of protruding lobes corresponding to the plurality of concave sides and a plurality of recesses corresponding to the plurality of convex sides, with each of the protruding lobes and the plurality of recesses extending along a second axis;

wherein the second driving body is pivotal from a first position aligned with the first driving body such that the first and second axes are aligned to a second position oriented at a maximum angle to the first driving body such that the first and second axes are tilted with respect to one another.

2. The driving tool as claimed in claim 1, wherein the two phantom circles are located in the receptacle, and wherein the phantom ellipse is located outside the receptacle.

3. The driving tool as claimed in claim 2, wherein a major axis of the phantom ellipse, which passes through a center of the phantom ellipse, is coaxial with a line extending from a center of the receptacle to the center of the phantom ellipse.

4. The driving tool as claimed in claim 2, wherein each of the plurality of protruding lobes has a curved top surface and two curved lateral surfaces, wherein the top surface is positioned between the two curved lateral surfaces, wherein each of the plurality of recesses extends between two protruding lobes adjacent thereto.

5. The driving tool as claimed in claim 4, wherein the two curved lateral surfaces of each of the plurality of protruding lobes are convex surfaces.

6. The driving tool as claimed in claim 2, wherein the maximum angle is an acute angle, and wherein the receptacle and the ball head have six points of contact therebetween when the second driving body is pivoted to the second position with respect to the first driving body.

7. The driving tool as claimed in claim 6, wherein the first driving body has a bore and a biasing member retained in the bore, and wherein the biasing member has an end abutting and urging the ball head.

8. The driving tool as claimed in claim 7 further comprising a retainer engaged between the first and second driving bodies for retaining the ball head in the receptacle, with the first driving body having a slot, with the retainer retained in the slot, and with the retainer extending annularly and abutting a circumference of the ball head at a height.

9. The driving tool as claimed in claim 7, wherein the second driving body has a drive head opposite the ball head, and wherein the drive head has a detent retained thereon.

10. The driving tool as claimed in claim 7, wherein the first driving body has a shaft adapted to be used as a lever extending longitudinally in a direction transverse to the first axis.

11. The driving tool as claimed in claim 1, wherein each of the plurality of protruding lobes has a curved top surface and two curved lateral surfaces, wherein the top surface is positioned between the two curved lateral surfaces, and wherein each of the plurality of recesses extends between two protruding lobes adjacent thereto.

12. The driving tool as claimed in claim 11, wherein the two curved lateral surfaces of each of the plurality of protruding lobes are convex surfaces.

13. The driving tool as claimed in claim 12, wherein the maximum angle is an acute angle, and wherein the receptacle and the ball head have six points of contact therebetween when the second driving body is pivoted to the second position with respect to the first driving body.

14. The driving tool as claimed in claim 1, wherein the maximum angle is an acute angle, and wherein the receptacle and the ball head have six points of contact therebetween when the second driving body is pivoted to the second position with respect to the first driving body.

15. The driving tool as claimed in claim 14, wherein the maximum angle is 25 degrees.

16. The driving tool as claimed in claim 1, wherein the number of the plurality of concave sides is six and the number of plurality of protruding lobes is six.

17. The driving tool as claimed in claim 1, wherein the first driving body has a bore and a biasing member retained in the bore, and wherein the biasing member has an end abutting and urging the ball head.

18. The driving tool as claimed in claim 1, wherein the second driving body has a drive head opposite the ball head, and wherein the drive head has a detent retained thereon.

19. The driving tool as claimed in claim 1, wherein the second driving body has a connecting end opposite the receptacle adapted to connect to a power tool, and wherein the connecting end defines a hole.

20. The driving tool as claimed in claim 1, wherein the first driving body has a shaft adapted to be used as a lever extending longitudinally in a direction transverse to the first axis.

* * * * *